US008454182B2

(12) United States Patent
Yang

(10) Patent No.: US 8,454,182 B2
(45) **Date of Patent: *Jun. 4, 2013**

(54) MOVING HEADLIGHT FOR STAGE LIGHTING

(75) Inventor: Jung Hsiang Yang, Shenzhen (CN)

(73) Assignee: IAG Group Limited, Shenzhen (CN)

( * ) Notice: Subject to any disclaimer, the term of this patent is extended or adjusted under 35 U.S.C. 154(b) by 168 days.

This patent is subject to a terminal disclaimer.

(21) Appl. No.: 12/879,456

(22) Filed: Sep. 10, 2010

(65) Prior Publication Data

US 2011/0292672 A1 Dec. 1, 2011

(30) Foreign Application Priority Data

May 27, 2010 (CN) ..... 2010 1 0190104

(51) Int. Cl.
*F21K 2/00* (2006.01)

(52) U.S. Cl.
USPC ..... 362/35; 362/241; 362/282; 362/284; 362/322; 362/324

(58) Field of Classification Search
USPC ..... 362/35, 241, 277, 282, 284, 322, 362/324, 543–545, 514, 517
See application file for complete search history.

(56) References Cited

U.S. PATENT DOCUMENTS

| | | | | |
|---|---|---|---|---|
| 2,947,970 | A * | 8/1960 | Oosten Van | 362/35 |
| 5,951,139 | A * | 9/1999 | Smith et al. | 362/33 |
| 6,705,745 | B1 * | 3/2004 | Pederson | 362/284 |
| 7,033,036 | B2 * | 4/2006 | Pederson | 362/35 |
| 2002/0041499 | A1 * | 4/2002 | Pederson | 362/545 |
| 2007/0263376 | A1 * | 11/2007 | Wilkinson et al. | 362/35 |
| 2009/0091914 | A1 * | 4/2009 | Nobayashi | 362/35 |

OTHER PUBLICATIONS

Co-pending U.S. Appl. No. 12/885,960, filed Sep. 20, 2010.

* cited by examiner

*Primary Examiner* — Laura Tso
(74) *Attorney, Agent, or Firm* — Hamre, Schumann, Mueller & Larson, P.C.

(57) ABSTRACT

A moving head light for stage lighting includes a light sources group having a plurality of light sources, a reflector group slantwise arranged at a circumference of the light sources group; and an angle-adjusting device for adjusting the relative angles between the reflectors and the light sources. Each reflector corresponds to each light source one by one, and the reflector group includes a plurality of reflectors. The moving head light for stage lighting uses the angle-adjusting device to adjust the relative angles between the reflectors and the light sources so that lights sent out from the light sources generate a special effect of scaling in a space after being reflected by the reflectors.

9 Claims, 3 Drawing Sheets

MOVING HEADLIGHT FOR STAGE LIGHTING

TECHNICAL FIELD

The present invention relates to stage lighting s, and more particularly, to a moving head light for stage lighting.

BACKGROUND

The moving head light is widely used, and is capable of using for performance centers, professional stages, bars, multifunctional halls and exhibition halls, etc. The conventional moving head light only has the simple functions of movable lighting and environment dyeing, so that the stage rendering effect is not good.

SUMMARY

The present invention aims at providing the moving head light for stage lighting to solve the problem that the stage rendering effect of the conventional moving head light is not good.

The present invention are carried out as follows: a moving head light for stage lighting includes a light sources group having a plurality of light sources, a reflector group which is slantwise arranged at the circumference of the light sources group, and an angle-adjusting device for adjusting the relative angles between the reflectors and the light sources; the reflector group includes a plurality of reflectors, and each reflector corresponds to each light source one by one.

The present invention uses the angle-adjusting device to adjust the relative angles between the reflectors and the light sources, so that lights sent out from the light sources generate a special effect of scaling in the space after being reflected by the reflectors, therefore, the stage rendering effect is good to make persons feel mystery and fantasy.

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

The moving head light for stage lighting in accordance with the present invention includes the light sources group having a plurality of light sources, the reflector group which is slantwise arranged at a circumference of the light sources group, and the angle-adjusting device for adjusting the relative angles between the reflectors and the light sources; and the reflector group includes a plurality of reflectors, and each reflector corresponds to each light source one by one.

The relative angles between the reflectors and the light sources are adjusted by using the angle-adjusting device in the embodiments of the invention, so that lights sent out from the light sources generate a special effect of scaling in the space after being reflected by the reflectors, therefore, the stage rendering effect is good.

The embodiments of the invention is further described by taking the LEDs as the light sources.

Embodiment 1

Figure 1:
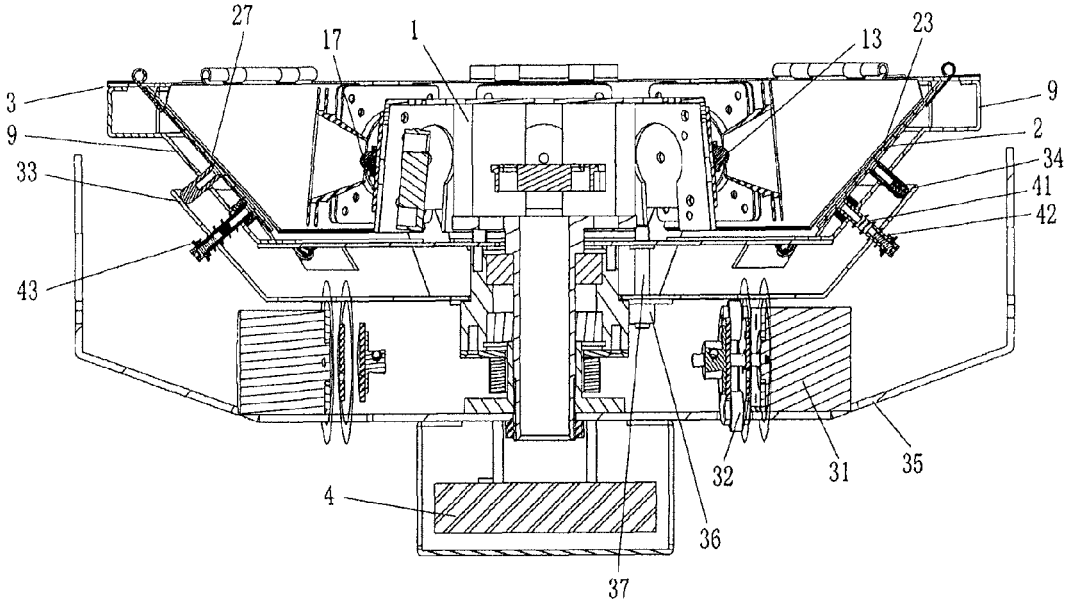
FIG. 1 is a sectional view of a moving head light for stage lighting in accordance with the present invention (when the faculae are shrunk)
Figure 2:
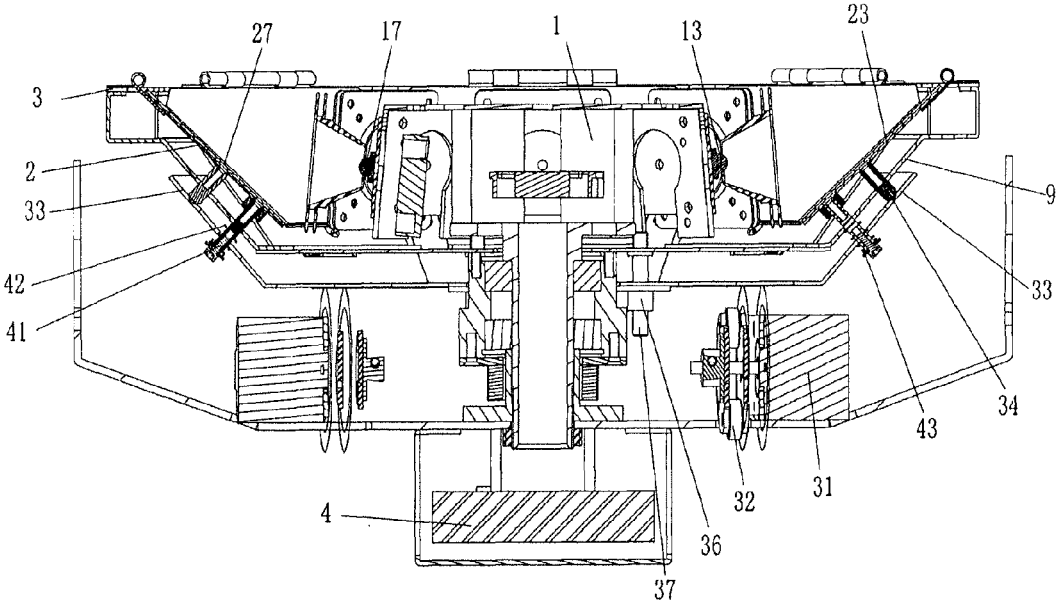
FIG. 2 is a sectional view of the moving head light for stage lighting in accordance with the present invention (when the faculae are opened)
Figure 3:
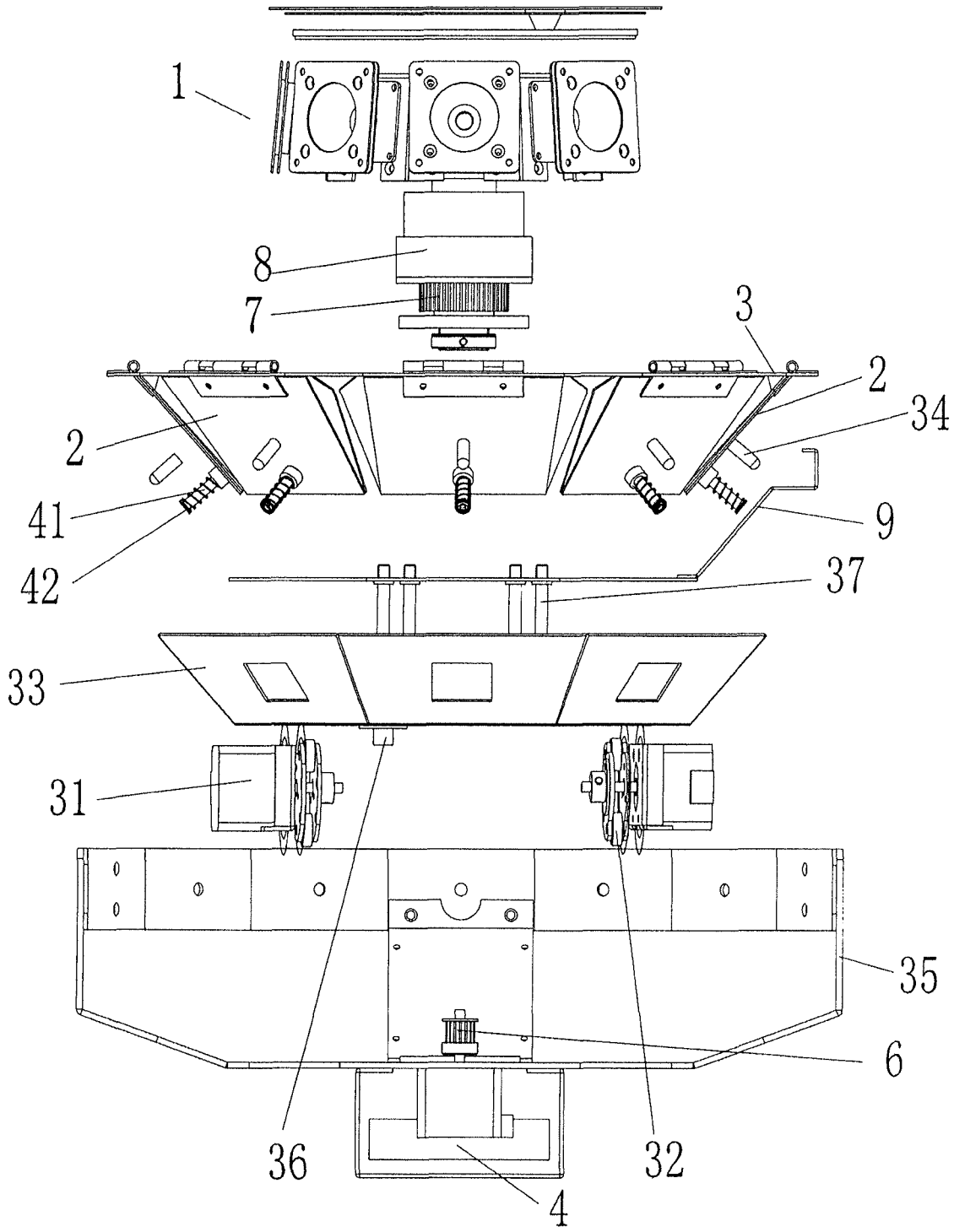
FIG. 3 is an exploded view of the moving head light for stage lighting in accordance with the present invention.
Figure 4:
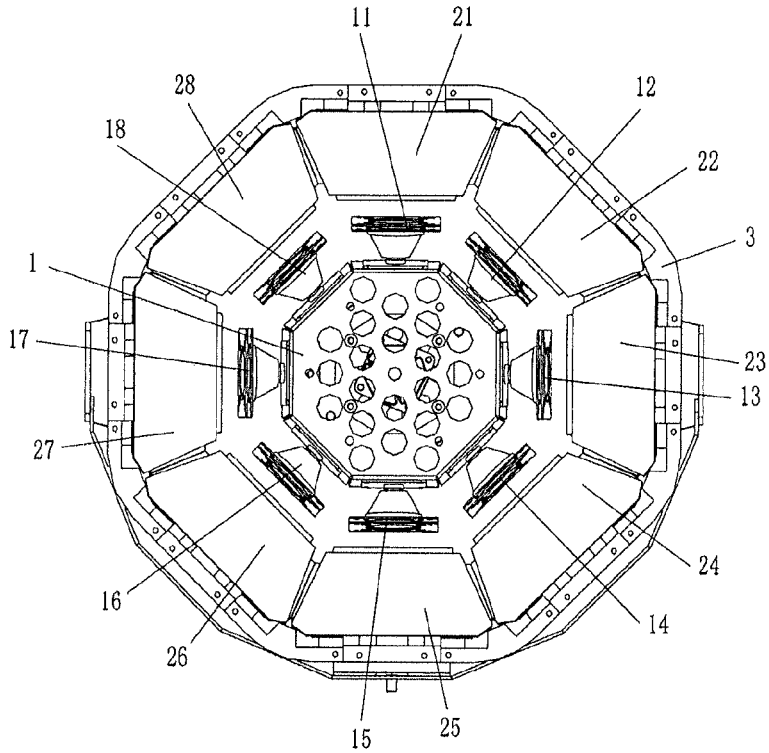
FIG. 4 is a top view of the moving head light for stage lighting in accordance with the present invention (when eight faculae are produced)
Figure 5:
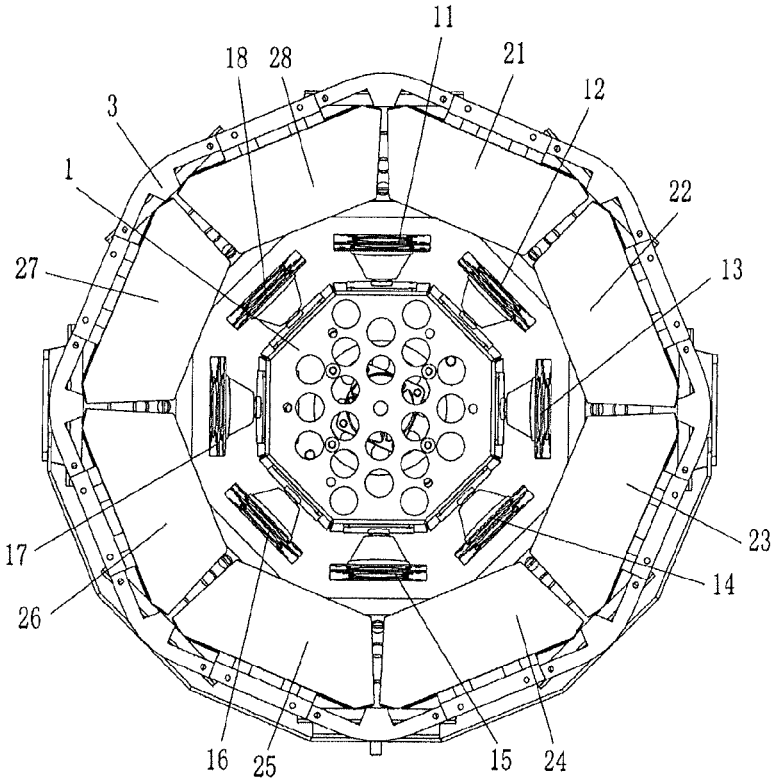
FIG. 5 is a top view of the moving head light for stage lighting in accordance with the present invention (when sixteen faculae are produced).

Referring to FIGS. 1-3, the moving head light for stage lighting in accordance with the invention includes the light sources group having eight LEDs. In detail, the light sources group includes: a first LED11, a second LED12, a third LED13, a forth LED14, a fifth LED15, a sixth LED16, a seventh LED17 and an eighth LED18; and each LED is arranged at each side of a light head 1.

Correspondingly, the moving head light for stage lighting includes the reflector group including eight reflectors. In detail, the reflector group includes a first reflectors 21, a second reflectors 22, a third reflectors 23, a forth reflectors 24, a fifth reflectors 25, a sixth reflectors 26, a seventh reflectors 27 and an eighth reflectors 28.

In the embodiment of the invention, the angle-adjusting device is arranged at a rear side of the reflectors, and the angle-adjusting device includes an angle-feed mechanism and an angle-resetting mechanism therein.

In detail, the angle-feed mechanism includes an angle-driving motor 31 which is fixedly arranged at a radial direction of a main bracket 35, a cam 32 driven by the angle-driving motor 31, an angle-pushing bracket 33 movably connected with the cam 32, an angle-adjusting bracket 3 abutted against the angle-pushing bracket 33, and a fixed bracket 9 integrated with the angle-adjusting bracket 3 in assembly. A plurality of movable side plates 2 for installing the reflectors is arranged on a side of the angle-adjusting bracket 3, an upper end of each movable side plate 2 is fixed, and a lower end thereof can move in a deflection way under the action of external force. The rear side of each movable side plate 2 is provided with a push rod 34 which is extended through the fixed bracket 9 to be movably abutted against the angle-pushing bracket 33.

A bottom portion of the angle-pushing bracket 33 is provided with a plurality of guiding sleeves 36, correspondingly, and the fixed bracket 9 is provided with a plurality of guiding columns 37 which are matched with the guiding sleeves 36. The cam 32 may be a bearing cam, and the frictional force between the angle-pushing bracket 33 and the bearing cam is smaller when the angle-pushing bracket is rotated.

The angle-resetting mechanism is an elastic resetting mechanism which includes a spring column 41 and a resetting spring 42 arranged at a periphery of the spring column 41. The spring column 41 is extended through a side wall of the fixed bracket 9 and the angle-pushing bracket 33. One end of the resetting spring 42 is limited by a stopping sheet 43 disposed at a distal end of the spring column 41, and the other end thereof is abutted against the rear side of the fixed bracket 9.

After starting the angle-driving motor 31, the cam 32 is rotated from a low position to a high position to drive the angle-pushing bracket 33 to lift up along a guiding column 37; the angle-pushing bracket 33 exerts force to the push rod 34, so that the side plate 2 of the angle-adjusting bracket 3 is upwards deflected, and the reflectors are upwards deflected simultaneously, at the moment, the fixed bracket 9 extrudes the resetting spring 32, and the upward deflected angles of the reflectors are 5-10 degrees. The cam 32 is rotated from the high position to the low position, the angle-pushing bracket 33 falls to the original position under the action of self-gravitation, the force exerted to the push rod 34 is disappeared, and the side plates 2 of the angle-adjusting bracket 3 are reset to the original position under the action of the resetting spring 42.

Referring to the FIG. 1, the side plates 2 are positioned at the original position, the lights sent out from the LEDs are reflected through the reflectors, and distances among faculae are nearer, so that the faculae are under the status of shrinkage to be like a flower bud.

When the reflector are deflected to the position of the FIG. 2, the lights sent out from the LEDs are reflected through the reflectors, and distances among faculae are further, so that the faculae are under the status of opening to be like a blooming flower.

The embodiment of the invention uses the angle-adjusting device to adjust the relative angles between the reflectors and the light sources, so that the lights sent out from the light sources generate a special effect of scaling in the space after being reflected by the reflectors, therefore, the stage rendering effect is good.

Embodiment 2

The second embodiment of the invention is additionally provided with a rotary drive device on the basis of the moving head light for stage lighting in accordance with the first embodiment of the invention. The rotary drive device drives the reflector group to rotate relative to the light sources group, the lights sent out from the light sources are projected to the space after being reflected by the reflectors, and the faculae are divided into two from one or jointed into one from two, consequently, the stage rendering effect is better.

In the second embodiment of the invention, the rotary drive device includes a rotary drive motor 4, a first gear 6 driven by the rotary drive motor 4, a second gear 7 engaged with the first gear 6, and a shaft sleeve 8 fixedly connected with the second gear 7. The fixed bracket 9 is fixedly connected with the shaft sleeve 8. The first gear 6 is connected with the second gear 7 via a belt.

Preferably, the light sources are white light LEDs with the luminous angles of 100-140 degrees and the power of 10 W. The included angles between the optic axis of the LEDs and the reflectors are 30-60 degrees.

When the angle-adjusting bracket 3 is rotated to the position as showed in the FIG. 1, the lights sent out from each LED are reflected via each reflector to be formed to have a facula. If all the LEDs are lightened, the eight faculae are generated in the space.

When the angle-adjusting bracket 3 is rotated to the position as showed in the FIG. 2, the lights sent out from the LEDs generate two faculae after being reflected by two adjoining reflectors as the LEDs have a certain luminous angle. If all the LEDs are lightened, the sixteen faculae are generated in the space.

According to live music and atmosphere, the angle-adjusting bracket rotates under the action of the rotary drive device to drive the reflector group to rotate around the light source group and change the number of the faculae. At the same time, the angle-adjusting device adjusts the relative angles between the reflectors and the light sources, so that the lights sent out from the light sources generate a special effect of scaling in the space after being reflected by the reflectors, consequently, the stage rendering effect is better.

In the invention, by using the angle-adjusting device to adjust the relative angles between the reflectors and the light sources, the lights sent out from the light sources generate a special effect of scaling in the space after being reflected by the reflectors, therefore, the stage rendering effect is better. Simultaneously, the additional rotary drive device leads the reflectors to rotate around the light sources, so that the lights sent out from the light sources are projected to the space after being reflected by the reflectors, and the faculae are divided into two from one and jointed into one from two, therefore, the stage rendering effect is better.

Also, according to the rhythm of the music and the performance atmosphere, by changing a rate of change of the relative angle between the reflector and the light source, the rotation rate of the reflector rotated around the light source is adjusted, so that the location and number of the faculae are changed with the change of scene, thereby providing a sort of fantasy feel.

The present invention may be embodied in other forms without departing from the spirit or novel characteristics thereof. The embodiment disclosed in this application is to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A moving head light for stage lighting comprising:
a light sources group having a plurality of light sources;
a reflector group slantwise arranged at a circumference of the light sources group, and the reflector group having a plurality of reflectors; and
an angle-adjusting device for adjusting the relative angles between the reflectors and the light sources,
wherein each reflector corresponds to each light source one by one, the reflectors are driven by the angle-adjusting device to deflect relative to the light sources, and the angle-adjusting device is arranged at a rear side of the reflectors.

2. The moving head light for stage lighting as claimed in claim 1, wherein the angle-adjusting device comprises an angle-feed mechanism and an angle-resetting mechanism.

3. The moving head light for stage lighting as claimed in claim 2,
wherein the angle-feed mechanism comprises an angle-driving motor, a cam driven by the angle-driving motor, an angle-pushing bracket movably contacted with the cam, an angle-adjusting bracket abutted against the angle-pushing bracket, and a fixed bracket securely connected with the angle-adjusting bracket; and movable side plates for installing the reflectors are arranged on a side of the angle-adjusting bracket, an upper end of each movable side plate is fixed, and a lower end thereof is provided with a push rod extended through the fixed bracket to be movably abutted against the angle-pushing bracket.

4. The moving head light for stage lighting as claimed in claim 2, wherein the angle-resetting mechanism is an elastic resetting mechanism comprising a spring column extended through the fixed bracket and a resetting spring arranged at a periphery of the spring column; and one end of the resetting spring is positioned at a distal end of the spring column, and the other end thereof is abutted against the fixed bracket.

5. The moving head light for stage lighting as claimed in claim 3, wherein a bottom portion of the angle-pushing bracket is provided with a plurality of guiding sleeves, and the fixed bracket is provided with a plurality of guiding columns matched with the guiding sleeves.

6. The moving head light for stage lighting as claimed in claim 3, wherein the reflector group is driven by a rotary drive device to rotate around the light sources group.

7. The moving head light for stage lighting as claimed in claim 6, wherein the rotary drive device comprises a rotary drive motor, a first gear driven by the rotary drive motor, a second gear engaged with the first gear, and a shaft sleeve fixedly connected with the second gear, wherein the shaft sleeve is fixedly connected with the fixed bracket.

8. The moving head light for stage lighting as claimed in claim 1, wherein the light source is an LED, and the luminous angle of the LED is 100-140 degrees.

9. The moving head light for stage lighting as claimed in claim 8, wherein an included angles between the optic axis of the LED and the reflectors are 30-60 degrees.

* * * * *